United States Patent [19]

Matsuda

[11] Patent Number: 4,622,709

[45] Date of Patent: Nov. 18, 1986

[54] CLEANING APPARATUS FOR PIPES

[76] Inventor: Shinichi Matsuda, 32-14, Higiriyama 1-chome, Konan-ku, Yokohama, Kanagawa 233, Japan

[21] Appl. No.: 715,961

[22] Filed: Mar. 26, 1985

[30] Foreign Application Priority Data

Apr. 16, 1984 [JP] Japan ..... 59-74940
Oct. 15, 1984 [JP] Japan ..... 59-214183

[51] Int. Cl.[4] ..... B08B 9/02

[52] U.S. Cl. ..... 15/4; 15/104.16; 15/104.3 R; 51/317; 51/411

[58] Field of Search ..... 15/104.05, 104.06 R, 15/104.16, 104.18, 104.3 R, 4; 51/317, 411

[56] References Cited

U.S. PATENT DOCUMENTS

| | | | |
|---|---|---|---|
| 1,612,842 | 1/1927 | Thompson et al. | 15/104.18 |
| 1,656,465 | 1/1928 | Baker | 15/104.18 |
| 2,157,421 | 5/1939 | McFarland | 15/104.18 |
| 2,173,606 | 9/1939 | Forster | 15/104.18 |
| 2,579,813 | 12/1951 | Frank | 15/104.18 |
| 4,314,427 | 2/1982 | Stoltz | 51/411 |

FOREIGN PATENT DOCUMENTS

| | | | |
|---|---|---|---|
| 398910 | 4/1909 | France | 15/104.3 R |

*Primary Examiner*—Edward L. Roberts
*Attorney, Agent, or Firm*—Oblon, Fisher, Spivak, McClelland & Maier

[57] ABSTRACT

The present invention relates to a cleaning apparatus for a pipe which comprises at least one scraping device having a plurality of scraping segments which are made of elastic metal plates and are radially elongated around an axis of the scraping device, and a grinding device which is connected behind the scraping device and has an ejection pipe which is rotatably supported by a tubular member and has at least one radially elongated portion having a nozzle at radially outer end thereof. The grinding device also has an electric motor for rotating the ejection pipe. The cleaning apparatus also has a hose which is connected behind the tubular member for supplying mixed flow of abrasive material and compressed air into the ejection pipe, and driving means for advancing the scraping device, the grinding device and the hose.

1 Claim, 7 Drawing Figures

FIG. 4
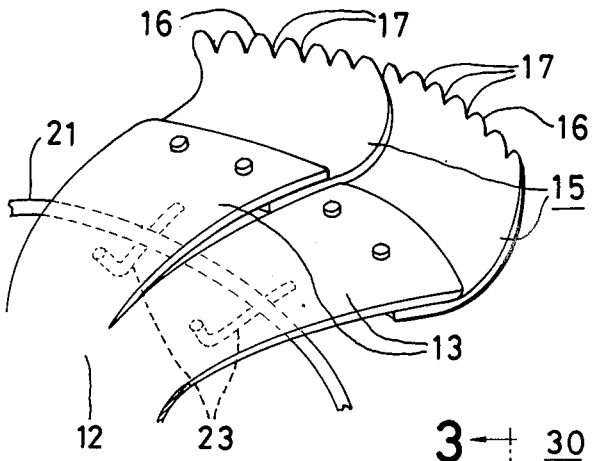
FIG. 5
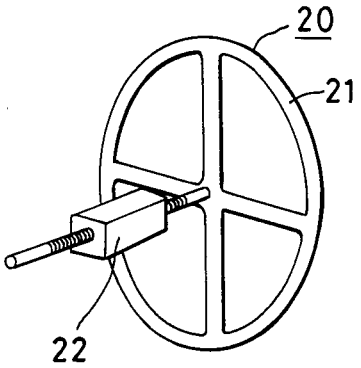
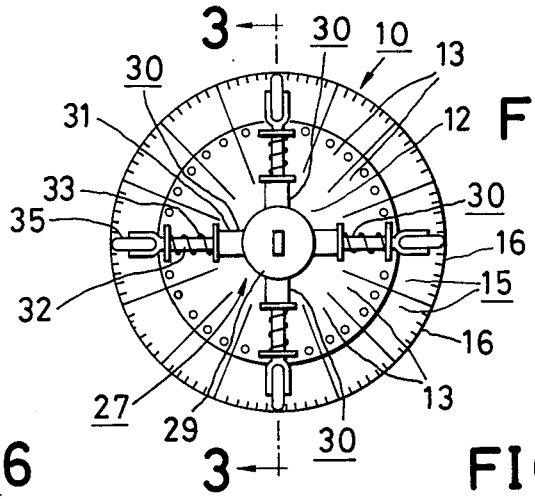
FIG. 2
FIG. 6
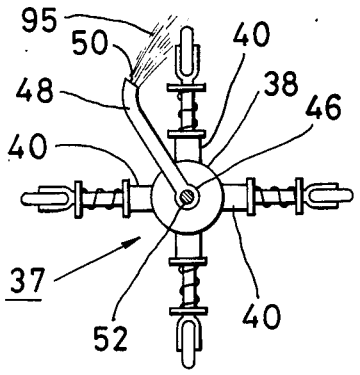
FIG. 7
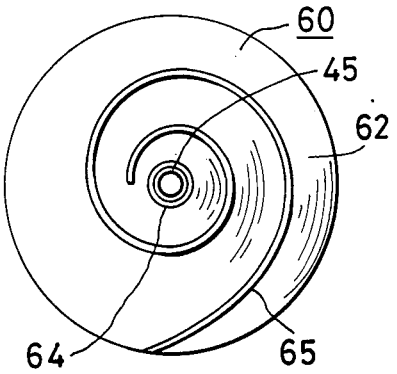

CLEANING APPARATUS FOR PIPES

FIELD OF THE INVENTION

This invention relates to a cleaning apparatus for pipes, and it more particularly relates to a cleaning apparatus for pipes having large interior diameters thereof. The pipes are made of metal and are used for passing fluid, for example water, gas, oil or the like therethrough. Various deposits such as rust, scale and other matter are attached to the interior surface of the pipes by use thereof. Therefore, it is necessary to remove the deposits from the interior surfaces of the pipes using the cleaning apparatus for pipes.

BACKGROUND OF THE INVENTION

Hitherto, various such cleaning apparatuses have been suggested. For example, an apparatus is disclosed in French Pat. No. 398,910 has a plurality of scraping devices connected by a wire roop or the like, each of the scraping devices has a plurality of scraping segments which are radially elongated for removing the deposits from the inner surface of the pipe. The apparatus is able to remove quickly the large deposits on the inner surface of the pipe, but it is very difficult to completely remove the deposits. In U.S. Pat. No. 4,314,427, another apparatus is disclosed which has a rotatable head member for impinging sand, grit, or other abrasive materials against inner periphery of a pipe at high pressure for cleaning the inner periphery of the pipe, therefore it is able to remove perfectly the deposits from the inner surface of the pipe, but it is not suitable for removing large deposits. Thus, a cleaning apparatus for a pipe which is suitable for removing large deposits from the inner surface of the pipe and providing perfect cleaning within a short time has not been provided.

OBJECT OF THE INVENTION

Accordingly, one object of the present invention is to provide a cleaning apparatus for a pipe which is suitable for removing large deposits from the interior surface of the pipe and completely cleaning of the pipe within a short time.

SUMMARY OF THE INVENTION

The present invention provides a cleaning apparatus for a pipe which comprises at least one scraping device having a plurality of scraping segments which are made of elastic metal plates and are radially elongated around an axis of the scraping device, and a grinding device which is connected behind the scraping device and has an ejection pipe which is rotatably supported by a tubular member and has at least one radially elongated portion having a nozzle at radially outer end thereof. The grinding device also has an electric motor for rotating the ejection pipe. The cleaning apparatus also has a hose which is connected behind the tubular member for supplying a mixed flow of abrasive material and compressed air into the ejection pipe, and driving means for advancing the scraping device, the grinding device and the hose.

BRIEF DESCRIPTION OF DRAWINGS

Other objects, features, and attendant advantages of the present invention will be more clear by following description referring to accompanying drawings, wherein:

FIG. 2 is a front view of the embodiment;

FIG. 4 is a perspective view partially showing a scraping device of the embodiment;

FIG. 5 is a perspective view showing an adjusting device;

FIG. 6 is a sectional view taken along the line 6—6 in FIG. 3; and

FIG. 7 is a sectional view taken along the line 7—7 in FIG. 3.

DETAILED DESCRIPTION

Figure 1:
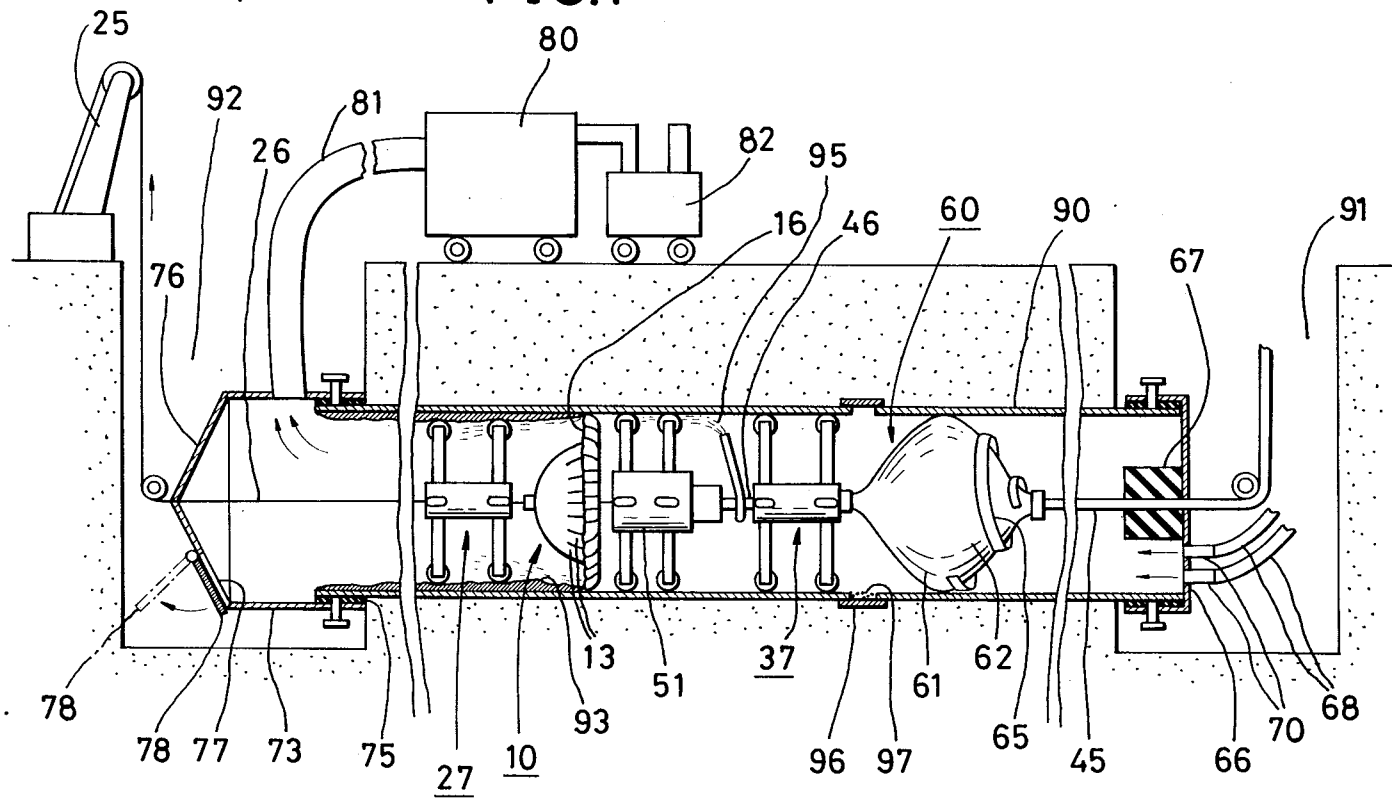
FIG. 1 is a side view of an embodiment of the present invention showing a using condition partially sectioned and partially cut away.
Figure 3:
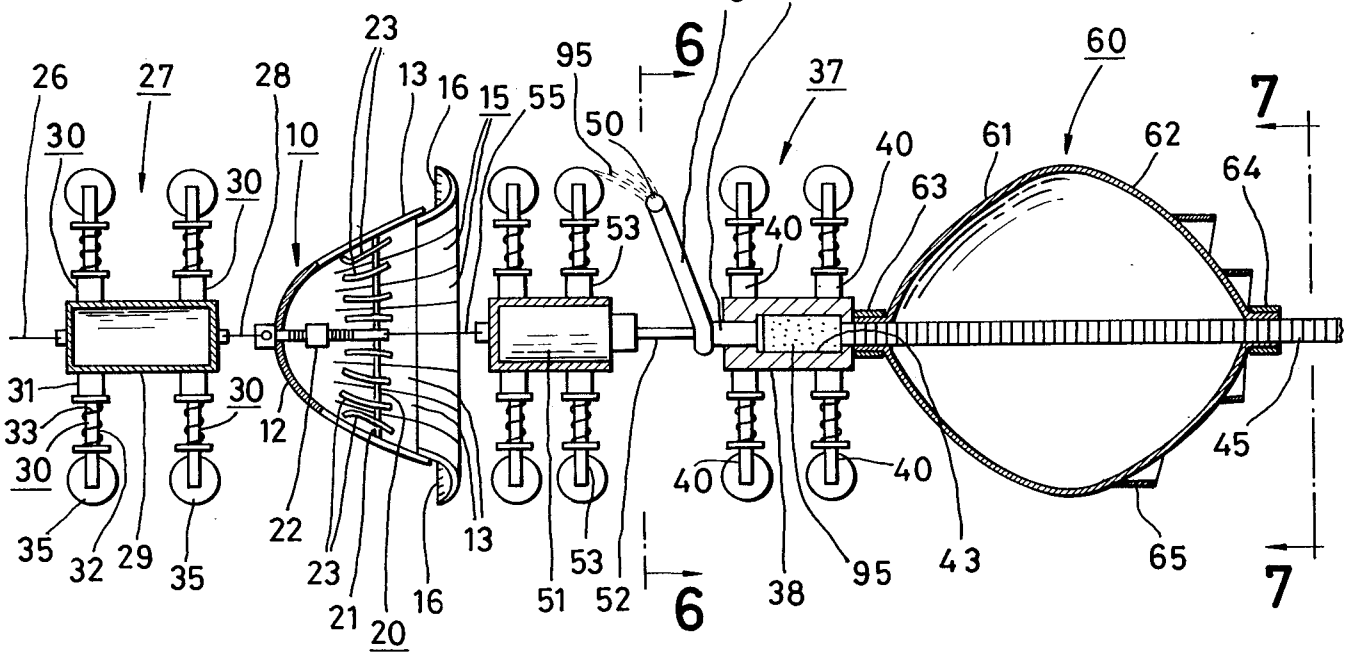
FIG. 3 is a sectional view taken along the line 3—3 in FIG. 2.

In an embodiment of the present invention shown in FIG. 1, a pipe 90 which is to be cleaned has a comparatively large inner diameter and is embedded in the earth. A pair of vertical bores 91, 92 are formed in the earth at both ends of the pipe 90 for cutting the connection with the both sides of the pipe. Various deposits 93 are attached to the interior surface of the pipe 90.

The apparatus includes a scratching device 10 which has a backwardly concaved central portion 12 and a plurality of branched portions 13 which are backwardly and radially elongated from the central portion 12. The central portion 12 and the branched portions 13 are made of elastic metal plate, but the central portion 12 may be made of hard metal plate which can not be deflected. The scraping device has scraping segments 15 which are made of elastically deformable metal plates and are fixed to the outer ends of the branched portions 13, respectively. The scraping segments 15 are disposed around an axis of the scraping device 10 and are radially elongated and have scraping portions 16 at the radially outer ends thereof which are forwardly bent and able to elastically contact the inner surface of the pipe 90. The scraping segment 15 may be made by elongation of the branched portion 13 and may not have forwardly bent portion. The scraping portion 16 prepherably has many short cut away portions 17 for good contact of the scraping portion 16 with the interior surface of the pipe 90. The scraping device 10 is associated with an adjusting device 20 for adjusting the width surrounded by the periphery thereof. The adjusting device 20 has an annular member 21 and a turnbuckle 22 connected between the annular member 21 and the central portion 12. The annular member 21 is able to be moved backwardly and forwardly using the turnbuckle 22 and engages with guide members 23 each of which fixed to the inner surface of the branched portion 13 at one end thereof. Therefore, the scraping device 10 can be converged or enlarged by moving the annular member 21 backwardly or forwardly, respectively, for elastic contact of the scraping portions 16 to the interior surface of the pipe 90. The apparatus may not have the adjusting device 20, wherein the branched portions 13 with the scraping segments 15 make elastic deformation for contact the periphery of the scraping device 10 to the interior surface of the pipe 90.

A winch 25 is provided and is connected to the scraping device 10 using a wire rope 26, guide device 27 and a wire rope 28. The guide device 27 has a centrel member 29 and a plurality of radially elongated arm devices 30 each of which is composed of a fixed portion 31 fixed to the central member 29, a movable portion 32 inserted into the fixed portion 31 at one end thereof, a coil spring 33 for forcing outwardly the movable portion 32, and a wheel 35 installed to the outer end of the movable portion 32. The guide device 27 is able to avoid the incline of the scraping device 10, especially in a not shown bent portion of the pipe 90.

A grinding device 37 is provided and is constructed as follows. A tubular member 38 is positioned so as to pass the central portion in the pipe 90 by means of a plurality of arm devices 40 each of which is composed of the same manner with the arm device 30. A passage 43 is formed through the tubular member 38. A hose 45 is connected to the passage 43 for feeding a mixed flow 95 which is mixed abrasive material such as sand, etc. with the compressed air. An ejection pipe 46 is rotatably supported at the front portion of the tubular member 38 and formed a radially elongated portion 48 which is somewhat inclined and has a nozzle 50 at radially outer end thereof. Therefore, by supplying the mixed flow 95 from the hose 45, the mixed flow is ejected from the nozzle 50, and the ejection pipe 46 receives a torque opposite the direction of the ejection from the nozzle 50. 51 designates an electric motor having not shown reduction gears and a shaft 52 which slowly drives the ejection pipe 46 with suitable rotating velocity by eliminating quick rotation thereof by the torque owing to the ejection. The motor 51 is supplied with an electric current from a not shown battery or using electric wire from the exterior. The motor 51 has a plurality of arm devices 53 each of which is formed in the same manner as the arm device 30 so that the motor is able to pass the central portion of the pipe 90. The motor 51 is connected so as to follow the adjusting device 20 using a wire rope 55.

A supporting device 60 is provided for support and progress of the hose 45 by receiving a force from an air flow fed from the back portion of the pipe 90. The supporting device is hollow and enlarged at the central portion thereof and projected to both sides thereof and has a front portion 61 and a back portion 62. The hose 45 penetrates the supporting device 60 and is fixed to the both ends 63, 64 of the supporting device 60. A vortical member 65 is projected at the back portion 62 of the supporting device 60 and makes a rotational movement of an air flow fed from the back portion of the pipe 90. The air flow made rotational movement is able to pass the clearance between the pipe 90 and the supporting device 60.

The pipe 90 is closed by a closing member 66 at the back end thereof. The hose 45 movably passes through the closing member using a rubber member 67 for maintain the air tightening. A plurality of inlet ports 70 are provided to the closing member 66 and hoses 68 are connected thereto for supplying compressed air from a not shown compressed air source. The compressed air from the inlet ports 70 progresses the supporting device 60 for supporting the hose 45 which has a heavy weight for passing the mixed flow 95. The compressed air passed through the clearance between the pipe 90 and the supporting device 60 progresses the scraping device 10. A tubular member 73 is fixed to the front end of the pipe 90 using a packing 75 made of rubber for the air tightening and has an end plate portion 76 which has an opening 77 releasably covered by a cover 78 at lower portion thereof. A dust collector 80 is connected to the upper portion of the tubular member 73 by means of a hose 81 and is associated with a vacuum suction device 82. By the suction of the vacuum suction device the dust collector filters the air passing therethrough and removes the deposits and the abrasive material or the like.

In use of the apparatus as described above, the winch 25 is driven for pulling the wire rope 26, the compressed air is supplied from the inlet ports 70, the vacuum suction device 82 is driven, the mixed flow 95 of the compressed air and the abrasive material is supplied from the hose 45, therefore the apparatus of the present invention is progressed in the pipe 90. In this case, the deposits 93 are almost entirely removed by the scraping device 10. The deposits 93 which have not been removed are easily removed by the grinding of the mixed flow 95 ejected from the ejection pipe 46, and the mixed flow 95 which is used for the grinding and includes the deposits is forwarded through the clearances such as the cut away portions 17 with the compressed air. The mixed flow with the removed deposits and the compressed air flowed in the front portion of the pipe 90 is flowed into the dust collector 80. The removed deposits and the abrasive material left in the bottom portion of the tubular member 73 can be removed by opening the cover 78 when the scraping device 10 has reached to the front end. In a downward concaved portion such as a connection portion 96 of the pipe 90 or the like, various small matters 97 such as the removed deposits, the abrasive material or the like are left behind. But, they are removed by the rotational movement of the air flow by means of the vortical member 65 of the supporting device 60.

In the present invention, the supporting device may not be installed, and the guide device 27 also may not be installed. The ejection pipe 46 of the grinding device 37 may be formed so as to have a plurality of radially elongated portions 48 with nozzles 50.

The foregoing is of course considered as illustrative only of the principle of the invention. Obviously, numerous modification are possible in light of the above teachings.

I claim:

1. A pipe cleaning apparatus comprising:

a scraping device having a plurality of scraping elements which are elongated in a radial direction relative to an axis, said scraping elements being disposed around said axis whereby radially outer portions of said scraping elements can annularly contact the interior of a pipe;

driving means for advancing said scraping device within said pipe in an advancing direction; and a grinding device connected to, and behind, said scraping device in said advancing direction, said grinding device including:

(a) an ejection pipe rotatably supported about said axis, said ejection pipe having a radially elongated portion terminating in a nozzle, (b) means for providing a mixture of compressed air and abrasive material to said ejection pipe for discharging from said nozzle, and (c) means for rotating said ejection pipe.

* * * * *